US009410468B2

(12) United States Patent
Nomura et al.

(10) Patent No.: US 9,410,468 B2
(45) **Date of Patent: *Aug. 9, 2016**

(54) TEMPERATURE SENSOR ATTACHMENT MEMBER TREATED WITH DRY FILM LUBRICANT

(71) Applicant: NGK SPARK PLUG CO., LTD., Nagoya-shi, Aichi (JP)

(72) Inventors: Takuma Nomura, Komaki (JP); Masamichi Ito, London (GB); Wakako Kinose, Nagosya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 162 days.

This patent is subject to a terminal disclaimer.

(21) Appl. No.: 14/264,408

(22) Filed: Apr. 29, 2014

(65) Prior Publication Data

US 2014/0318228 A1 Oct. 30, 2014

(30) Foreign Application Priority Data

Apr. 30, 2013 (JP) ..... 2013-095050
Mar. 20, 2014 (JP) ..... 2014-059261

(51) Int. Cl.
*G01M 15/10* (2006.01)
*F01N 13/00* (2010.01)
*F01N 13/16* (2010.01)

(52) U.S. Cl.
CPC ..... *F01N 13/008* (2013.01); *F01N 13/16* (2013.01); *F01N 2560/06* (2013.01)

(58) Field of Classification Search
CPC ... F01N 13/008; F01N 2560/06; G01M 15/10
USPC ..... 73/114.69, 114.75
See application file for complete search history.

(56) References Cited

U.S. PATENT DOCUMENTS 4,029,472 A * 6/1977 Micheli et al. ..... 422/108
4,929,507 A * 5/1990 Nishihara et al. ..... 428/447

(Continued)

FOREIGN PATENT DOCUMENTS

CN 1974737 A 6/2007
JP 61-136013 A 6/1986

(Continued)

OTHER PUBLICATIONS

Communication dated Jan. 26, 2015, issued by the State Intellectual Property Office of the People's Republic of China in Application No. 201280048076.0.

(Continued)

*Primary Examiner* — Eric S McCall
(74) *Attorney, Agent, or Firm* — Sughrue Mion, PLLC

(57) ABSTRACT

A temperature sensor (1) is configured such that a ring pressure section (21) is fixed to a ring seat face (39*b*) by screwing a fixing member (25) into a screw attachment member (37) in a state in which the ring pressure section (21) is seated on the ring seat face (39*b*), and pressing a front-end facing surface (25*b*) of the fixing member (25) against a rear-end facing surface (21*c*) of the ring pressure section (21). A dry film (41) containing an organic silicon polymer having a polycarbosilane skeleton that is cross-linked by a metal element and a solid lubricant such as molybdenum disulfide and mica is provided on at least one of the front-end facing surface (25*b*) of the fixing member (25) and the rear-end facing surface (21*c*) of the ring pressure section (21).

4 Claims, 2 Drawing Sheets

(56) References Cited

U.S. PATENT DOCUMENTS

| | | | | |
|---|---|---|---|---|
| 2002/0039378 | A1 | 4/2002 | Shibayama | |
| 2003/0147452 | A1* | 8/2003 | Adachi et al. | 374/185 |
| 2007/0123436 | A1 | 5/2007 | Kato et al. | |
| 2009/0169900 | A1* | 7/2009 | Oberle et al. | 428/450 |
| 2012/0021955 | A1 | 1/2012 | Kato et al. | |
| 2014/0235514 | A1* | 8/2014 | Nomura et al. | 508/107 |

FOREIGN PATENT DOCUMENTS

| | | | |
|---|---|---|---|
| JP | 62-54768 | A | 3/1987 |
| JP | 63-12672 | A | 1/1988 |
| JP | 2-134407 | A | 5/1990 |
| JP | 4-18456 | A | 1/1992 |
| JP | 2002-122486 | A | 4/2002 |
| JP | 2007-169597 | A | 7/2007 |
| JP | 2010-180360 | A | 8/2010 |
| JP | 2013-76036 | A | 4/2013 |

OTHER PUBLICATIONS

Communication dated May 26, 2016 issued by Japanese Intellectual Property Office in Japanese Patent Application No. 2014-059261.

* cited by examiner

TEMPERATURE SENSOR ATTACHMENT MEMBER TREATED WITH DRY FILM LUBRICANT

BACKGROUND OF THE INVENTION

1. Field of the Invention

The present invention relates to an attachment member for an internal combustion engine that is attached to a screw attachment member. The screw attachment member is mounted on a flow pipe (an exhaust pipe) through which exhaust gas from an internal combustion engine flows.

2. Description of the Related Art

Known attachment members for attachment to a flow pipe of an internal combustion engine through which exhaust gas flows include a temperature sensor for detecting the temperature of the exhaust gas, a gas sensor for detecting the concentration of a specific gas composition in the exhaust gas, a particle sensor for detecting the particle mass in the exhaust gas, and a pressure sensor for detecting the pressure of the exhaust gas. The configuration of a temperature sensor described in Patent Literature 1 is conventionally known as one example of an attachment member for an internal combustion engine. A temperature sensor is attached to an exhaust pipe in a vehicle in order to detect the temperature of exhaust gas in the exhaust pipe while having a temperature sensing section such as a thermistor element and a Pt resistor element disposed in the exhaust pipe.

A boss including a ring seat face and a screw attachment member are mounted on an exterior wall of the exhaust pipe. Meanwhile, the temperature sensor includes a ring pressure section to be seated on the ring seat face and a fixing member (nut). The fixing member has a cylindrical shape and includes a threaded section on its outer periphery, the threaded section being screwable into the screw attachment member. While the threaded section of the fixing member is screwed (fastened) into the screw attachment member of the boss in a state in which the ring pressure section is seated on the ring seat face of the boss, a front-end facing surface of the fixing member is pressed against a rear-end facing surface of the ring pressure section. In this manner, the ring pressure section is fixed to the ring seat face to attach the temperature sensor to the boss (the exhaust pipe).

Thus, while the temperature sensor is attached to the exhaust pipe by a fastening axial force imparted by screwing the fixing member into an attaching member, the temperature sensor is exposed to the heat of exhaust gas once attached. When the temperature sensor is exposed to the heat of exhaust gas, the section of the boss of the exhaust pipe where the temperature sensor is attached, that is, the screw attachment member and the ring seat face, and the sections of the temperature sensor including the ring pressure section pressed against the ring seat face and the fixing member, may reach a high temperature such as 200 to 500° C., or 500° C. or higher depending on the circumstances. Therefore, when even one of the ring pressure section and the fixing member that constitute the temperature sensor and the boss that includes the screw attachment member is made from a material having a coefficient of thermal expansion largely different from that of the other members, the ring pressure section separates from the ring seat face of the boss based on the difference in coefficient of thermal expansion to possibly result in a loose screwing state. In order to solve this problem, in Patent Literature 1, the boss that includes the ring seat face, and the ring pressure section and the fixing member that constitute the temperature sensor are made to have approximately the same thermal deformation amount to prevent the screw from becoming loose.

[Patent Literature 1] JP-A-2002-122486

3. Problems to be Solved by the Invention

In the technique of Patent Literature 1, a restriction is placed on materials employed for forming not only the ring pressure section and the fixing member that constitute the temperature sensor, but also the boss that includes the screw attachment member and the ring seat face. Those materials should have approximately the same thermal deformation amount (e.g., be made of the same material). Thus, in attaching the temperature sensor to the exhaust pipe (boss), there is a drawback in that a realistic range in which the attachment member can be properly attached is extremely narrow. On the other hand, although lifting the restriction in selection of materials may increase flexibility in attaching the temperature sensor to the exhaust pipe, or expand the range of application of the temperature sensor to the exhaust pipe, eventually the above-described problem of the screw becoming loose must be taken into consideration.

In order to increase flexibility in attaching the temperature sensor to the flow pipe such as the exhaust pipe, or to expand the range of application of the temperature sensor to the flow pipe, one possible solution is to increase the fastening axial force itself. This is provided by screwing the fixing member into the flow pipe, so as to prevent the ring pressure section from separating from the ring seat face of the boss even when the temperature sensor is exposed to a high temperature. The screw is thereby prevented from becoming loose. However, because a friction coefficient by a contact surface (friction surface) between the fixing member and the ring pressure section is large, increasing the driving torque (tightening torque) of the fixing member in order to obtain a large fastening axial force is limited. In addition, when an excessive tightening torque is applied to the fixing member, the fixing member or the screw attachment member could be broken, so that it is not easy to increase the fastening axial force of the temperature sensor.

While the above problems are explained using a temperature sensor as an example, the same considerations may also arise among other attachment members for an internal combustion engine. These attachment members are configured such that while a threaded section provided to a fixing member is screwed into a screw attachment member of a boss of an exhaust pipe in a state where a ring pressure section is seated on a ring seat face of the boss, a top-end facing surface of the fixing member is pressed against a rear-end facing surface of the ring pressure section.

SUMMARY OF THE INVENTION

The present invention has been made to solve the above problems, and an object of the present invention is to provide an attachment member for an internal combustion engine that is capable of increasing the fastening axial force on a flow pipe to prevent a screw from becoming loose.

The above object of the present invention has been achieved by providing (1) an attachment member for an internal combustion engine that is attached to a screw attachment member mounted on a flow pipe through which exhaust gas exhausted from an internal combustion engine flows, the attachment member comprising: a ring pressure section having a front-end facing surface that is seated on a ring seat face provided on an exterior wall of the flow pipe; and a fixing member having a cylindrical shape and comprising a threaded section on an outer periphery of the fixing member, the threaded section being screwable into the screw attachment member, the ring pressure section being fixed to the ring seat face by screwing the fixing member into the screw attachment member in a state in which the ring pressure section is seated on the ring seat face, and pressing a front-end facing surface of the fixing member that is closer to a front-end side than the threaded section against a rear-end facing surface of the ring pressure section, wherein a dry film comprising an organic silicon polymer having a polycarbosilane skeleton that is cross-linked by a metal element and a solid lubricant is provided on at least one of the front-end facing surface of the fixing member and the rear-end facing surface of the ring pressure section.

In a preferred embodiment (2) of the above attachment member (1), the solid lubricant comprises at least one of molybdenum disulfide and mica.

In another preferred embodiment (3) of the attachment member (1) or (2) above, the dry film is also provided also on a surface of the threaded section of the fixing member.

In yet another preferred embodiment (4), the attachment member of any of (1) to (3) above comprises a temperature sensor including a temperature sensing section arranged to detect the exhaust gas temperature, and is attached to the screw attachment member of the flow pipe such that the temperature sensing section protrudes into the flow pipe.

Advantages of the Invention

According to the attachment member for an internal combustion engine of the present invention (1), at least one of the front-end facing surface that is closer to the top end side than the threaded section of the fixing member and the rear-end facing surface of the ring pressure section is provided with the dry film containing the solid lubricant. The dry film thus applied can prevent the materials of the friction surfaces from coming into direct contact with each other even when both of the friction surfaces are pressed against each other. On the other hand, if a liquid lubricant such as a lubricant oil is used, the liquid lubricant leaks to the outside to thereby exhaust the supply of lubricant (oil). Consequently, the materials of the friction surfaces come into direct contact with each other. Further, the sliding properties provided by the solid lubricant contained in the dry film can favorably reduce the friction coefficient between the materials of the friction surfaces of the fixing member and the ring pressure section. Thus, even when screwing (fastening) the fixing member into the screw attachment member with a predetermined tightening torque, the reduction in friction coefficient between the materials of the friction surfaces caused by pressing the front-end facing surface of the fixing member against the rear-end facing surface of the ring pressure section (in other words, by performing a relative movement) allows the fixing member to be effectively screwed (fastened) into the screw attachment member. In this manner, the fastening axial force of the attachment member for an internal combustion engine can be increased more effectively as compared with a conventional attachment member for an internal combustion engine.

In addition, the organic silicon polymer contained in the dry film has sufficient heat resistance under high temperatures such as 500 to 800° C. In other words, the polymer itself is not easily decomposed so as to vaporize/evaporate, and is not easily lost on heating. Therefore, the dry film itself is thermally stable even under a high temperature environment such as 500° C. or higher. Thus, a change in quality due to a long period of use under a high temperature environment as well as loosening of the screw can be prevented under an actual operating environment of the attachment member for an internal combustion engine.

While examples of the solid lubricant include molybdenum disulfide, graphite, mica and boron nitride, a solid lubricant that is at least one of molybdenum disulfide and mica is preferably used as described in the preferred embodiment (2) of the invention. These solid lubricants have excellent heat resistance. In addition, molybdenum disulfide and mica have a layered crystal structure, so that when the ring pressure section and the ring seat face are rotated relative to each other with screwing in a state where the front-end facing surface of the fixing member is pressed against the rear-end facing surface of the ring pressure section, sliding is facilitated between the layered crystals (between the layers). As a result, the low friction characteristics provided by the solid lubricant (the dry film) can be exhibited more effectively. This configuration allows the fastening axial force of the attachment member for an internal combustion engine to be further increased.

According to the attachment member for an internal combustion engine according to the preferred embodiment (3) of the invention, the dry film is also provided on a surface of the threaded section of the fixing member. This configuration can reduce the friction coefficient between the materials of the friction surfaces of the screw attachment member and the threaded section of the fixing member. As a result, the fixing member can be effectively screwed (fastened) into the screw attachment member, and thus the fastening axial force of the attachment member for an internal combustion engine can be increased more effectively.

In recent years, the temperature of the environment inside of gas exhaust pipes through which exhaust gas exhausted from internal combustion flows passes has been increasing. Consequently, when an attachment member for an internal combustion engine is attached to a flow pipe, ring members and screw attachment members are sometimes exposed to a temperature of 500° C. or higher. Examples of the above-described attachment members for an internal combustion engine include temperature sensors having a temperature sensing section. Therefore, among these temperature sensors, a temperature sensor including a dry film can avoid a change in quality due to a long period of use under a high temperature environment and can prevent a screw from becoming loose under an actual operating environment of the temperature sensor.

DESCRIPTION OF REFERENCE NUMERALS

Figure 1:
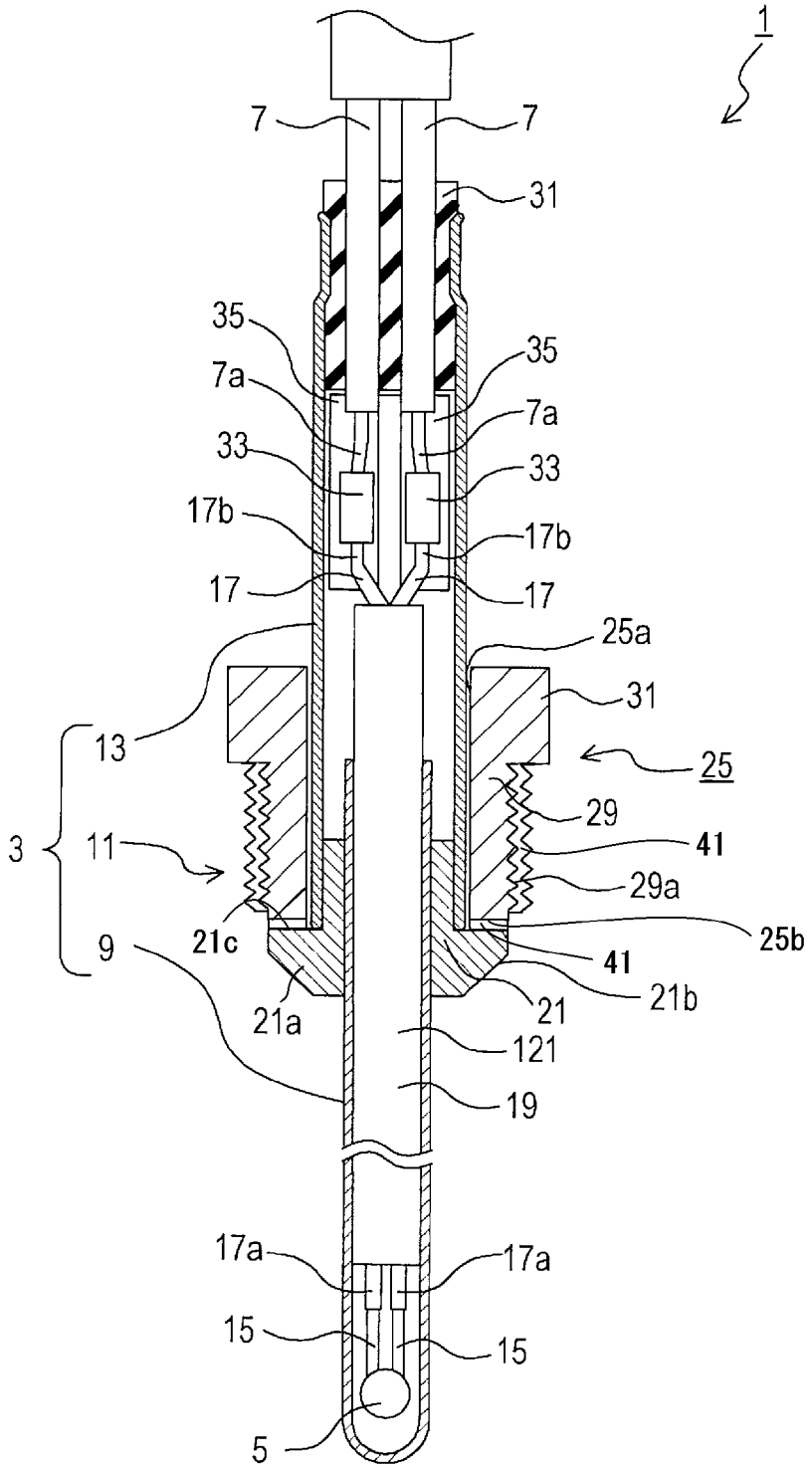
FIG. 1 is a cross-sectional view of an attachment member for an internal combustion engine (temperature sensor) according to a preferred embodiment of the present invention taken along the axial direction.

Reference numerals used to identify various structural features in the drawings include the following.

1 Attachment member for an internal combustion engine (temperature sensor)

5 Thermistor element (heat-sensitive unit)

23 Exhaust pipe (flow pipe)

21 Ring pressure section
21*c* Rear-end facing surface (of the ring pressure section)
25 Fixing member
25*b* Front-end facing surface (of the fixing member)
27 Boss
29 Threaded section
37 Screw attachment member
39*b* Ring seat face
41 Dry film

DETAILED DESCRIPTION OF THE PREFERRED EMBODIMENTS

Hereinafter, the configuration of an attachment member for an internal combustion engine of the present invention will be described with reference to the drawings. However, the present invention should not be construed as being limited thereto.

An attachment member 1 for an internal combustion engine according to a preferred embodiment of the invention is defined by a temperature sensor 1 (hereinafter, the attachment member 1 for an internal combustion engine is referred to as the temperature sensor 1) that is attached to an exhaust pipe of an internal combustion engine of an automobile or the like, and is arranged to detect the temperature of exhaust gas that flows through the exhaust pipe.

While not shown, the attachment member 1 may be a gas sensor for detecting the concentration of a specific gas composition in the exhaust gas (more specifically, an oxygen sensor for detecting the concentration of oxygen, and a nitrogen oxide sensor for detecting the concentration of nitrogen oxides), a particle sensor for detecting a particle mass (PM) in the exhaust gas, a pressure sensor for detecting the pressure of the exhaust gas, a flow volume sensor for detecting the flow volume of the exhaust gas, a heater for heating a catalyst arranged in the exhaust pipe, and the like.

As shown in FIG. 1, the temperature sensor 1 includes a housing 3, a thermistor element 5 that is housed in the housing 3 and defines a temperature sensing section that is capable of outputting an electric signal that varies with temperature, and a pair of lead wires 7 for taking the electric signal outputted from the thermistor element 5 out of the housing 3.

The housing 3 includes in more detail a first housing 9 on the front-end side (shown in the bottom portion of FIG. 1), an intermediate section 11, and a second housing 13 on the rear end side (shown in the upper portion of FIG. 1). The first housing 9 has the shape of a cylinder having a closed bottom, and includes the thermistor element 5 for outputting an electric signal that varies with temperature to a pair of electrodes 15, the thermistor element 5 being disposed on the inner side closer to the front-end of the first housing 9. The pair of electrodes 15 are connected to one ends 17*a* of a pair of core wires 17. The pair of core wires 17 is covered with a sheath member 19 (i.e., for insulation), and the core wires 17 on the rear end side of the sheath member 19 protrude from the first housing 9. The sheath member 19 has a configuration which keeps the pair of core wires 17 insulated inside of a metallic external cylinder 121 having a cylindrical shape.

The second housing 13 has a circular cylindrical shape larger in diameter than the first housing 9. The front-end portion of the second housing 13 and the rear end portion of the first housing 9 overlap coaxially, and are connected to each other on the rear end side of a ring pressure section 21.

The intermediate section 11 includes the ring pressure section 21 that defines a member for preventing exhaust gas from leaking and is fixed to a ring seat face 39*b* of a boss 27 described below, and a fixing member 25 having a cylindrical shape arranged to screw and thereby fix the temperature sensor 1 to an exhaust pipe 23 (see also FIG. 2). The fixing member 25 defines a nut.

The ring pressure section 21 is welded and fixed to an outer periphery on the rear end side of the first housing 9. The front-end portion of the second housing 13 is welded and fixed to an outer periphery of a cylindrical portion that is on the rear end side of the ring pressure section 21. The ring pressure section 21 includes a protruding portion 21*a* protruding in a radial direction, a tapered surface 21*b* provided at the front-end of the protruding portion 21*a*, and a rear-end facing surface 21*c* approximately flat and provided at the rear end of the protruding portion 21*a*.

Meanwhile, the fixing member 25 is disposed rotatably on an outer periphery of the ring pressure section 21 on the side of the second housing 13. The fixing member 25 defines a member that is screwed into a screw attachment member 37 of the boss 27, and includes a central hole 25*a* at its axis center, a threaded section 29 including a male screw 29*a* (external thread) formed on its outer periphery, and a hexagon nut section 31 provided on the rear end side of the threaded section 29. In addition, a front-end facing surface 25*b* that is approximately flat is provided at the front-end of the fixing member 25, and is arranged to press the rear-end facing surface 21*c* of the ring pressure section 21 after attaching the temperature sensor 1. In the temperature sensor 1, a dry film 41 containing an organic silicon polymer having a polycarbosilane skeleton that is cross-linked by a metal element and a solid lubricant is provided on the front-end facing surface 25*b* of the fixing member 25 as described below.

The other ends 17*b* of the pair of core wires 17 protruding from the rear end side of the first housing 9 are crimped by one ends 7*a* of the pair of lead wires 7 and crimping terminals 33 inside of the second housing 13. In addition, an insulation tube 35 covers the peripheries of the other ends 17*b* of the pair of core wires 17 and the one ends 7*a* of the pair of lead wires 7 so as to also surround the crimping terminals 33.

Further, a seal member 31 made of heat-resisting rubber is crimped so as to be fixed to the inward side closer to the rear end of the second housing 13, and the inside of the second housing 13 is thereby made watertight. The pair of lead wires 7 passes completely through the seal member 31 to protrude from the rear end of the second housing 13, and the lead wires 7 are connected to a connector for external circuit connection (not illustrated).

Next, a description of the structure of the temperature sensor 1 attached to the exhaust pipe 23 will be given.

Figure 2:
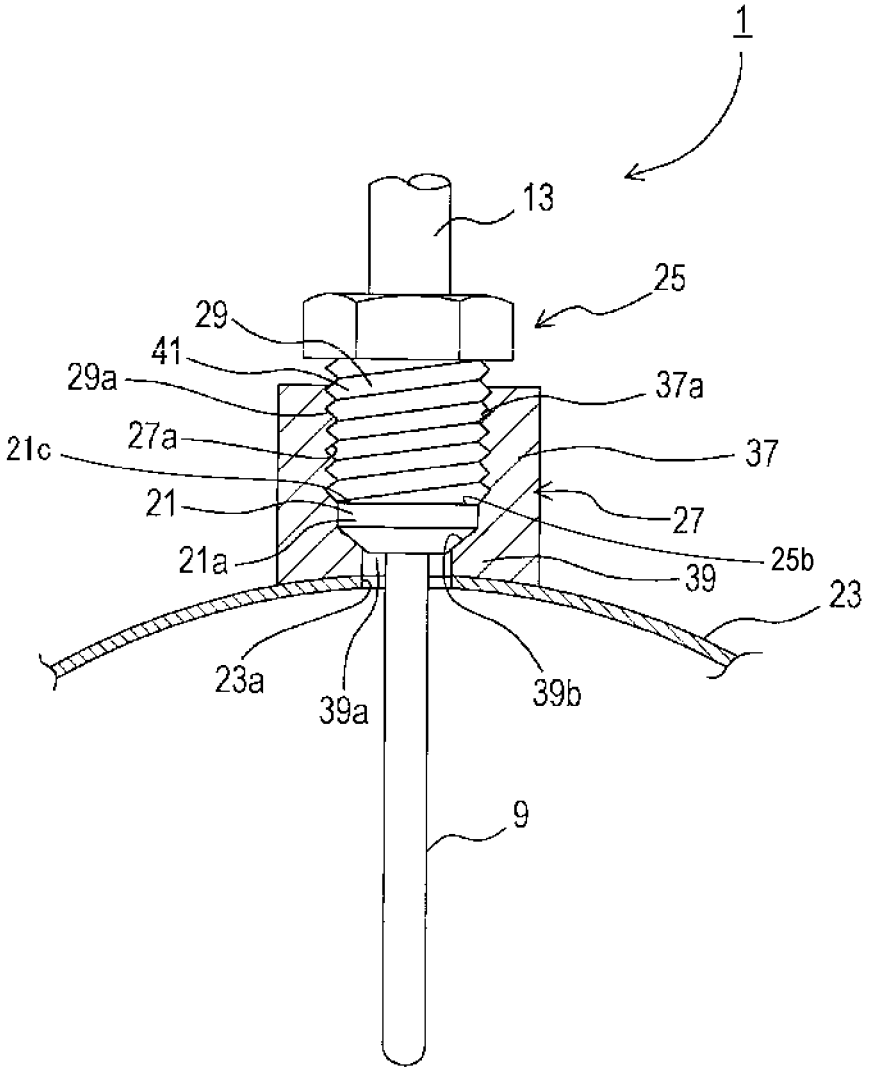
FIG. 2 is a cross-sectional view of the attachment member for an internal combustion engine (temperature sensor) according to a preferred embodiment of the present invention, the attachment member being attached to a flow pipe through which exhaust gas flows, and where relevant sections are shown in cross section.

While an attachment structure of the temperature sensor 1 is shown in FIG. 2, the temperature sensor 1 is attached vertically with respect to the axial direction of the exhaust pipe 23 of a vehicle, and is used to detect the temperature of exhaust gas over a wide temperature range.

In the attachment structure of the temperature sensor 1, the boss 27 is connected to the exhaust pipe 23 by welding such that a through hole 23*a* opened in the exhaust pipe 23 is in communication with a central hole 27*a* of the boss 27. Then, the temperature sensor 1 is attached to the exhaust pipe 23 (the boss 27) such that the front-end of the first housing 9 protrudes into the exhaust pipe 23 from the through hole 23*a* of the exhaust pipe 23, that is, such that the thermistor element 5 is disposed inside of the exhaust pipe 23.

The boss 27 defines a member into which the fixing member 25 is screwed, and includes the screw attachment member 37 including a female screw 37*a* (internal thread) formed on an inner periphery of the central hole 27*a*, and a connecting portion 39 disposed closer to the exhaust pipe 23 than the screw attachment member 37. The connecting portion 39 includes an insertion hole 39*a* that is smaller in diameter than the smallest diameter of the screw attachment member 37, and the ring seat face 39*b* having a ring shape and including a tapered surface is provided on an inside wall of the insertion hole 39*a*.

The ring member 21 is made, for example, from SUS310S or SUS430. The fixing member 25 is made, for example, from, SUS430, SUS304 or SUSXM7. The boss 27 including the ring seat face 39*b* and the screw attachment member 37 is made, for example, from a ferritic metal typified by SUS430, or an austenitic metal typified by SUS304. In the attachment structure of the temperature sensor 1, the fixing member 25 is not fixed to the ring pressure section 21 or the second housing 13, and is rotatable. The temperature sensor 1 is attached to the exhaust pipe 23 with the use of the fixing member 25 as follows.

First, while the first housing 9 on the top end side of the temperature sensor 1 is passed through the central hole 27*a* of the boss 27 and the through hole 23*a* of the exhaust pipe 23, the ring pressure section 21 and the top end of the second housing 13 are inserted into the central hole 27*a* of the boss 27 to seat the ring pressure section 21 on the ring seat face 39*b* of the boss 27.

The male screw 29*a* (external thread) of the threaded section 29 of the fixing member 25 is screwed into the female screw 37*a* (internal thread) of the screw attachment member 37 of the boss 27 in this state, and the fixing member 25 is screwed into the boss 27 (the screw attachment member 37) to fix the fixing member 25 to the boss 27 with a predetermined tightening torque (in other words, the ring pressure section 21 is fixed to the ring seat face 39*b*). At this time, the fixing member 25 rotates while the front-end facing surface 25*b* of the fixing member 25 is pressed against the rear-end facing surface 21*c* of the ring pressure section 21, and the tapered surface 21*b* of the ring pressure section 21 is pressed against the ring seat face 39*b* of the boss 27 and thereby fixed.

In the temperature sensor 1 according to the above embodiment of the present invention, the dry film 41 is provided on at least either one of the front-end facing surface 25*b* of the fixing member 25 and the rear-end facing surface 21*c* of the ring pressure section 21. Specifically, in the temperature sensor 1, a dry film 41 having, for example, a thickness of 10 μm is provided on the front-end facing surface 25*b* of the fixing member 25 as show in FIG. 1. In addition, in the temperature sensor 1, the dry film 41 having, for example, a thickness of 10 μm is provided not only on the front-end facing surface 25*b* of the fixing member 25 but also on a surface of the threaded section 29. The thickness of the dry film 41 is exaggeratingly shown in FIG. 1.

Hereinafter, the dry film 41 will be described.

The dry film 41 is a solid film different from a liquid lubricant, and contains an organic silicon polymer and a solid lubricant. The organic silicon polymer is a polymer having a main chain of a polycarbosilane skeleton (—(Si—C)n-) that is cross-linked by a metal element such as Ti, Zn, Cr and Mo (more specifically, a metal-organic compound). An organic silicon polymer that is cross-linked by Ti (metal element) is used as the organic silicon polymer contained in the dry film 41 according to the above embodiments of the present invention, and this polymer is also referred to as a TYRANNO resin (product of UBE Industries, Ltd.). Even when heat-treated in an air atmosphere at 1000° C. for ten hours or more, this organic silicon polymer exhibits a small loss on heating, so that a change in quality such as shrinkage and cracking due to weight reduction in the film which would make the dry film 41 dense does not easily occur.

In addition, examples of the solid lubricant contained in the dry film 41 include molybdenum disulfide, graphite and mica. Among them, the use of a solid lubricant that is at least one of molybdenum disulfide and mica is preferred. The content of the solid lubricant is preferably within a range of 10 to 400 parts by mass to 100 parts by mass of organic silicon polymer. Less than 10 parts by mass of solid lubricant to 100 parts by mass of organic silicon polymer results in a crack in the course of film formation. Meanwhile, more than 400 parts by mass of solid lubricant reduces the ratio of the organic silicon polymer, which could reduce the bonding force (adhesion) of the dry film 41 with the surface of the fixing member 25 or the ring pressure section 21. From the view point of providing stable film formation, the content of the solid lubricant is more preferably within a range of 25 to 300 parts by mass to 100 parts by mass of organic silicon polymer.

Specifically, the dry film 41 according to the above embodiment of the present invention contains a TYRANNO resin, and molybdenum disulfide that constitutes the solid lubricant is uniformly dispersed in the TYRANNO resin. The dry film 41 has a composition of 150 parts by mass of molybdenum disulfide to 100 parts by mass of TYRANNO resin.

In addition, the dry film 41 can be formed as follows. Specifically, after subjecting the fixing member 25 or the ring pressure section 21 to a binder burnout process, the fixing member 25 or the ring pressure section 21 is subject to surface preparation in order to improve adhesion of the dry film 41 and then to a washing treatment. Then, a coating composition (containing an organic solvent in addition to an organic silicon polymer and a solid lubricant) that is to be cured by drying or heating and which is a precursor of the dry film 41 is applied by spraying a target section (target surface) of the fixing member 25 or the ring pressure section 21. If the dry film 41 need not be formed on the fixing member 25 or the ring pressure section 21, the coating composition is applied after masking unnecessary sections. Lastly, the fixing member 25 or the ring pressure section 21 to which the coating composition is applied is dried at room temperature or heated to be cured, and thus the dry film 41 is formed.

In the temperature sensor 1 where thus-formed dry film 41 is provided on the front-end facing surface 25*b* of the fixing member 25, even when the front-end facing surface 25*b* of the fixing member 25 is pressed against the rear-end facing surface 21*c* of the ring pressure section 21 in the course of attaching the fixing member 25 to the boss 27, leakage does not occur. However, leakage would occur in the case of using a liquid lubricant such as a lubricant oil that leaks to the outside to hereby exhaust the lubricant (oil) supply. Thus, the presence of the dry film 41 can prevent the materials of friction surfaces of the front-end facing surface 25*b* and the rear-end facing surface 21*c* from coming into direct into contact with each other. Further, the sliding properties provided by the solid lubricant (molybdenum disulfide) contained in the dry film 41 can favorably reduce the friction coefficient between the materials of the friction surfaces of the front-end facing surface 25*b* of the fixing member 25 and the rear-end facing surface 21*c* of the ring pressure section 21. Thus, even when screwing (fastening) the fixing member 25 into the screw attachment member 37 with a predetermined tightening torque, the reduction in friction coefficient between the materials of the friction surfaces caused by pressing the front-end facing surface 25*b* of the fixing member 25 against the rear-end facing surface 21*c* of the ring pressure section 21 allows the fixing member 25 to be effectively screwed (fastened) into the boss 27 (the screw attachment member 37), and thus the fastening axial force of the temperature sensor 1 can be increased considerably.

In addition, because the organic silicon polymer contained in the dry film 41 has sufficient heat resistance, the polymer itself is not easily decomposed to vaporize/evaporate, and thereby a loss on heating does not easily occur. Therefore, the dry film 41 itself is thermally stable even under a high temperature environment such as 500° C. or higher, and thus a change in quality (deterioration) due to a long period of use under a high temperature environment and loosening of the screw loose under an actual operating environment of the temperature sensor 1 can be prevented.

Further, in the temperature sensor 1 according to the above embodiment of the invention, the dry film 41 is also provided on the surface of the threaded section 29 (the male screw 29*a*) of the fixing member 25. This configuration can reduce the friction coefficient between the materials of the friction surfaces of the screw attachment member 37 of the boss 27 and the threaded section 29 of the fixing member 25, and thereby the fixing member 25 can be effectively screwed (fastened) into the screw attachment member 37. In this manner, the fastening axial force of the temperature sensor 1 can be increased more effectively. Further, because the quality of the dry film 41 does not easily change even under a high temperature environment such as 500° C. or higher, the screwing section of the screw attachment member 37 and the threaded section 29 of the fixing member 25 can be prevented from seizing.

Next, a description of the effect obtained by providing the dry film 41 on the front-end facing surface 25*b* of the fixing member 25 will be given. Two temperature sensors 1 having the configuration shown in FIG. 1 were prepared where the dry film 41 having a thickness of 10 μm was provided on the front-end facing surface 25*b* of the fixing member 25 of one of the two temperature sensors 1, while no dry film 41 was provided on the front-end facing surface 25*b* of the fixing member 25 of the other temperature sensor 1 as a comparative example. In that state, the two temperature sensors 1 were attached to an installation jig with a predetermined tightening torque, and the axial forces at that time were measured with the use of a load cell. The evaluation results thereof are that the temperature sensor 1 according to the invention where the dry film 41 was provided to the fixing member 25 exhibited a very high axial force of about 900 N per torque1N-m, while the temperature sensor 1 where no dry film 41 was provided to the fixing member 25 exhibited a low axial force of about 189 N per torque1N-m. The above results show that the temperature sensor 1 according to the present invention is capable of providing an improved fastening axial force on the flow pipe (exhaust pipe 23) so as to prevent the screw from becoming loose.

The foregoing description of the above embodiment of the present invention has been presented for purposes of illustration and description; however, it is not intended to be exhaustive or to limit the present invention to the precise form disclosed, and the present invention extends to various modifications and equivalents that are within the scope and spirit of the claims appended hereto.

For example, while in the above-described embodiment of the present invention, the dry film 41 is provided on the front-end facing surface 25*b* of the fixing member 25, the dry film 41 may be provided on the rear-end facing surface 21*c* of the ring pressure section 21 instead of the fixing member 25, or may be provided both on the fixing member 25 and the ring pressure section 21. In addition, while in the above-described embodiment, the dry film 41 is provided not only on the front-end facing surface 25*b* of the fixing member 25 but also on the surface of the threaded section 29 (that is, the male screw 29*a*), the dry film 41 may be omitted on the surface of the threaded section 29 so as to focus on improving the fastening axial force of the temperature sensor.

This application is based on Japanese Patent Application Nos. 2013-095050 filed Apr. 30, 2013 and 2014-059261 filed Mar. 20, 2014, the above applications incorporated herein by reference in their entirety.

What is claimed is:

1. An attachment member for an internal combustion engine that is attached to a screw attachment member mounted on a flow pipe through which exhaust gas exhausted from the internal combustion engine flows, the attachment member comprising:

a ring pressure section having a front-end facing surface that is seated on a ring seat face provided on an exterior wall of the flow pipe; and a fixing member having a cylindrical shape and comprising a threaded section on an outer periphery of the fixing member, the threaded section being screwable into the screw attachment member, the ring pressure section being fixed to the ring seat face by screwing the fixing member into the screw attachment member in a state which the ring pressure section is seated on the ring seat face, and pressing a front-end facing surface of the fixing member that is closer to a front-end side than the threaded section against a rear-end facing surface of the ring pressure section, wherein a dry film comprising an organic silicon polymer having a polycarbosilane skeleton that is cross-linked by a metal element and a solid lubricant is provided on at least one of the front-end facing surface of the fixing member and the rear-end facing surface of the ring pressure section.

2. The attachment member for an internal combustion engine as claimed in to claim 1, wherein the solid lubricant comprises at least one of molybdenum disulfide and mica.

3. The attachment member for an internal combustion engine as claimed in claim 1, wherein the dry film is also provided on a surface of the threaded section of the fixing member.

4. The attachment member for an internal combustion engine as claimed in claim 1, which comprises a temperature sensor including a temperature sensing section arranged to detect the exhaust gas temperature, and is attached to the screw attachment member of the flow pipe such that the temperature sensing section protrudes into the flow pipe.

* * * * *